US011611823B2

(12) United States Patent
Tsuchihashi

(10) Patent No.: US 11,611,823 B2
(45) Date of Patent: Mar. 21, 2023

(54) HEADPHONE

(71) Applicant: Yamaha Corporation, Hamamatsu (JP)

(72) Inventor: Yuu Tsuchihashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/395,754

(22) Filed: Aug. 6, 2021

(65) Prior Publication Data

US 2022/0046354 A1 Feb. 10, 2022

(30) Foreign Application Priority Data

Aug. 7, 2020 (JP) ..... JP2020-134978

(51) Int. Cl.
*H04R 1/28* (2006.01)
*H04R 1/10* (2006.01)

(52) U.S. Cl.
CPC ..... *H04R 1/2846* (2013.01); *H04R 1/1008* (2013.01)

(58) Field of Classification Search
CPC ..... H04R 1/1008; H04R 1/1075; H04R 2460/11; H04R 1/023; H04R 1/1091; H04R 1/025; H04R 1/2811; H04R 1/2869; H04R 1/2873; H04R 1/2884; H04R 1/2888
See application file for complete search history.

(56) References Cited

U.S. PATENT DOCUMENTS 10,469,939 B1 * 11/2019 Tikander ..... H04R 1/1008
2017/0238089 A1 8/2017 Honda et al.
2020/0213703 A1 7/2020 Yoneyama

FOREIGN PATENT DOCUMENTS

CN 111314818 A 6/2020
EP 2 750 406 A1 7/2014
JP 2020-5174 A 1/2020

OTHER PUBLICATIONS

Extended European Search Report issued in European Application No. 21189712.9 dated Dec. 23, 2021 (seven (7) pages).

* cited by examiner

*Primary Examiner* — Kile O Blair
(74) *Attorney, Agent, or Firm* — Crowell & Moring LLP

(57) ABSTRACT

A headphone include a speaker unit, a baffle plate, and an ear pad. The baffle plate supports the speaker unit. The ear pad is attached to a front surface of the baffle plate. The baffle plate has at least one cell having a cavity. A part of the at least one cell has a hole communicated with the cavity. The hole is provided in at least one of the front surface of the baffle plate and a back surface of the baffle plate opposite to the front surface.

9 Claims, 6 Drawing Sheets

HEADPHONE

CROSS-REFERENCE TO RELATED APPLICATIONS

This application is based on and claims priority under 35 USC 119 from Japanese Patent Application No. 2020-134978 filed on Aug. 7, 2020, the contents of which are incorporated herein by reference.

TECHNICAL FIELD

The present disclosure relates to a headphone.

BACKGROUND

Many acoustic devices such as a speaker and a headphone have a configuration in which a speaker unit is supported by a baffle plate. In such an acoustic device, the baffle plate has a great influence on acoustic characteristics. Therefore, various techniques for improving acoustic characteristics by improving the baffle plate are proposed in the field of such an acoustic device. For example, there is a technique for solving a problem related to a baffle plate of a speaker.

It is required to suppress or reduce standing waves generated in an enclosed space surrounded by a front surface of a baffle plate, an ear pad, and a head of a user in a headphone. Among various types of headphones, there is a sealed headphone in which a back surface of the baffle plate is covered with a housing. In such a sealed headphone, it is required to suppress or reduce both standing waves generated in an enclosed space surrounded by a front surface of the baffle plate, an ear pad, and a head of a user and standing waves generated in an enclosed space surrounded by the back surface of the baffle plate and the housing.

SUMMARY

The present disclosure has been made in view of the circumstances described above, and an object of the present disclosure is to provide a headphone that can suppress or reduce standing waves generated in a space facing a baffle plate.

Aspect of non-limiting embodiments of the present disclosure relates to provide a headphone including: a speaker unit, a baffle plate that supports the speaker unit, and an ear pad attached to a front surface of the baffle plate, in which the baffle plate has at least one cell having a cavity, and in which a part of the at least one cell has a hole communicated with the cavity, and the hole is provided in at least one of the front surface of the baffle plate and a back surface of the baffle plate opposite to the front surface.

DETAILED DESCRIPTION

Hereinafter, an embodiment of the present disclosure will be described with reference to the drawings.

Figure 1:
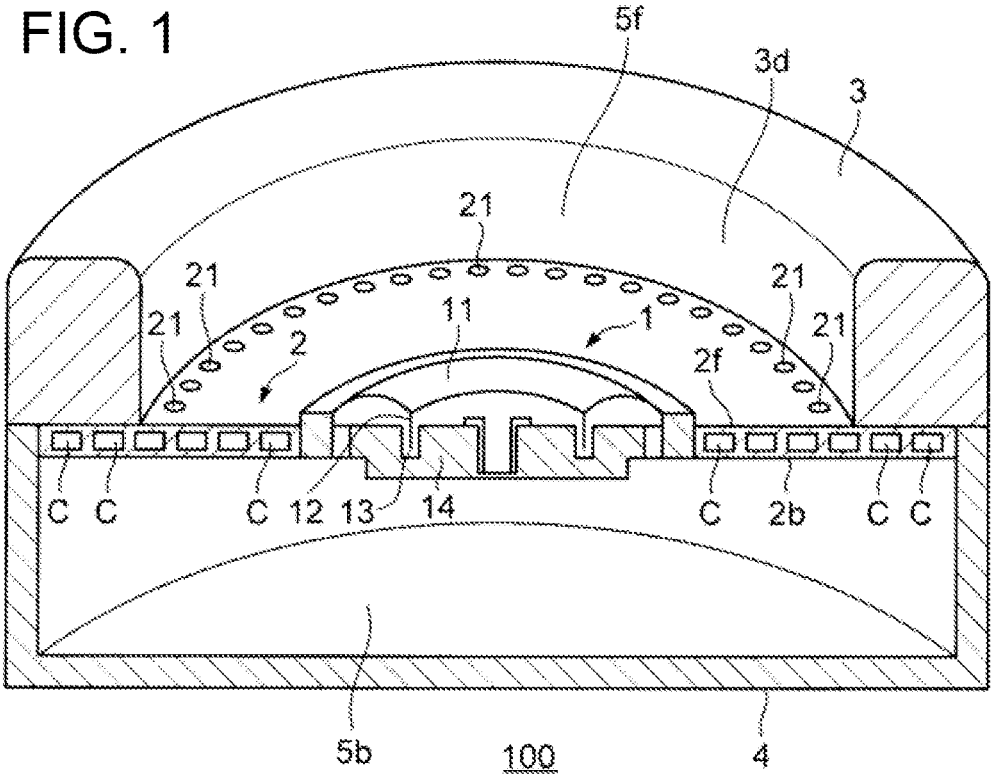
FIG. 1 is a cross-sectional view showing a configuration of an inventive headphone.

FIG. 1 is a cross-sectional perspective view showing a configuration of a headphone 100 according to an embodiment of the present disclosure. In the headphone 100, a speaker unit 1 is supported at a substantial center portion of a baffle plate 2 having a substantially circular shape. Here, the speaker unit 1 is an electromagnetic speaker unit. The speaker unit 1 includes a diaphragm 11 having a substantial disc shape and a periphery of the diaphragm 11 being fixed, a voice coil bobbin 12 attached to a lower surface of the diaphragm 11, and a magnetic circuit 14 provided with a magnetic gap 13 into which the voice coil bobbin 12 is inserted. In the speaker unit 1, when the voice coil bobbin 12 is energized, the diaphragm 11 vibrates in an upper-lower direction in the drawing, and a sound is emitted to an upper side and a lower side in the drawing.

A substantially annular ear pad 3 is attached to a periphery portion of a front surface 2*f* of the baffle plate 2. The ear pad 3 is a member that comes into contact with a head of a user when the headphone 100 is used.

A side of the baffle plate 2 opposite to the front surface 2*f* is a back surface 2*b*. The headphone 100 includes a hollow lid-like housing 4 that covers the back surface 2*b* of the baffle plate 2.

When the headphone 100 is used, a front cavity 5*f* surrounded by the front surface 2*f* of the baffle plate 2, an inner wall surface 3*d* of the ear pad 3, and the head of the user is formed. A back cavity 5*b* is provided at a back surface 2*b* side of the baffle plate 2, and the back cavity 5*b* is an enclosed space surrounded by the back surface 2*b* and an inner wall surface of the housing 4. That is, the housing 4 is a back surface member that forms an enclosed space between the housing 4 and the back surface 2*b* of the baffle plate 2.

In the headphone 100, a sound emitted from the diaphragm 11 of the speaker unit 1 to the front surface 2*f* side of the baffle plate 2 is transmitted in the front cavity 5*f*. A sound emitted from the diaphragm 11 of the speaker unit 1 to the back surface 2*b* side of the baffle plate 2 is transmitted in the back cavity 5*b*.

Figure 2:
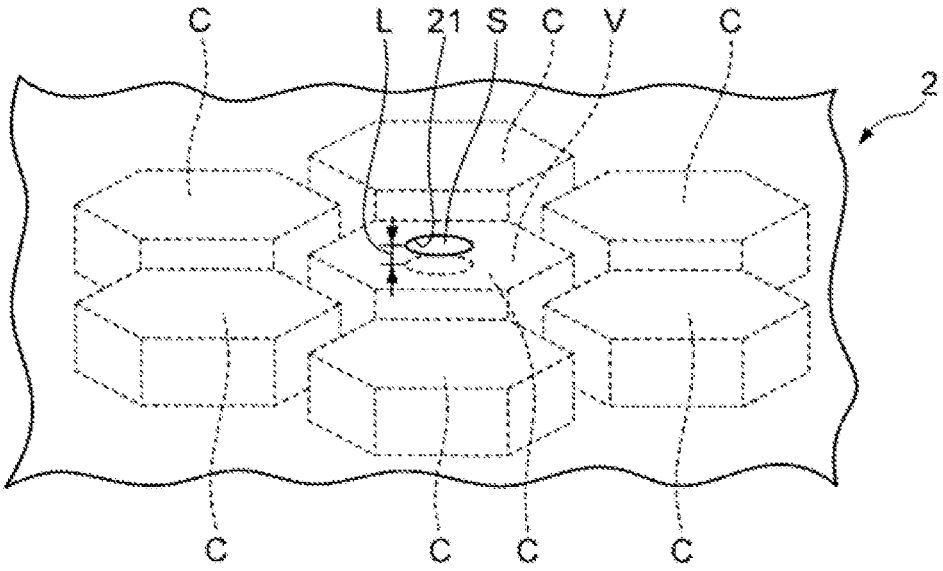
FIG. 2 is a perspective view showing a configuration of a baffle plate of the inventive headphone.

FIG. 2 is a perspective view showing a configuration of the baffle plate 2. In the present embodiment, a plurality of cells C having cavities are formed at different positions in a plane parallel to a plate surface of the baffle plate 2, and each of the cells C has a regular hexagonal prism shape. More specifically, the cells C are formed in the baffle plate 2 in a manner in which one side surface of six side surfaces of the regular hexagonal prism shape of each cell C is parallel to one side surface of six side surfaces of an adjacent cell C, and the cells C are separated from one another at a certain distance. All of the cells C have the same shape and the same volume in the present embodiment.

Some of the plurality of cells C in the baffle plate 2 have a hole 21 communicated with a cavity of a cell C in the front surface 2*f* or the back surface 2*b* of the baffle plate 2. Such a cell C functions as a Helmholtz resonator. A resonance frequency fr of the Helmholtz resonator can be calculated by the following formula, in which a cross-sectional area of the hole 21 is S, a depth of the hole 21 is L, a volume of the cavity of the cell C communicated with the hole 21 is V, and a sound velocity is c.

$$fr=(c/2\pi)\sqrt{(S/(V\cdot L))} \quad (1)$$

For example, when the cross-sectional area S of the hole 21 is 0.79 $mm^2$ (corresponding to an area of a circle having a diameter of 1 mm), the depth L of the hole 21 is 2 mm, and the volume V of the cavity of the cell C communicated with the hole 21 is 65 $mm^3$, the Helmholtz resonance frequency fr is a value near 4.2 kHz.

Figure 3:
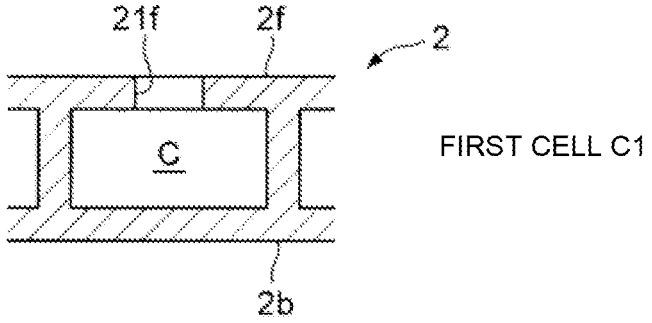
FIG. 3 is a cross-sectional view showing a configuration of a first cell provided in the baffle plate.
Figure 4:
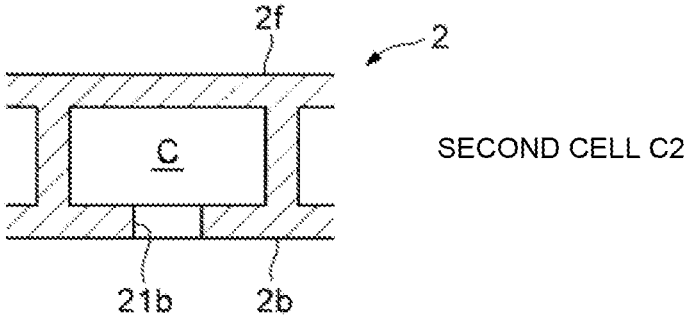
FIG. 4 is a cross-sectional view showing a configuration of a second cell provided in the baffle plate.
Figure 5:
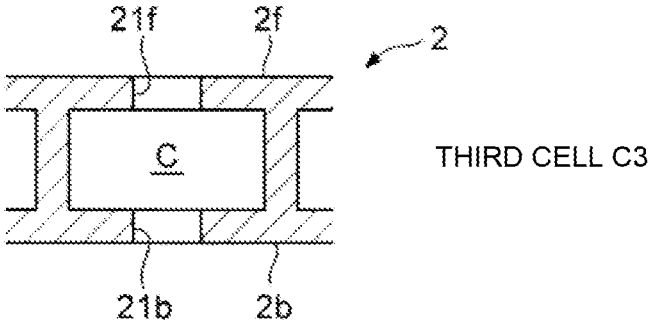
FIG. 5 is a cross-sectional view showing a configuration of a third cell provided in the baffle plate.

FIG. 3 is a cross-sectional view showing a first cell C1 formed in the baffle plate 2. FIG. 4 is a cross-sectional view showing a second cell C2 formed in the baffle plate 2. FIG. 5 is a cross-sectional view showing a third cell C3 formed in the baffle plate 2.

A cavity of the first cell C1 shown in FIG. 3 is communicated with a hole 21*f* provided in the front surface 2*f* of the baffle plate 2. The first cell C1 is used as a portion that suppresses or reduce standing waves generated in the front cavity 5*f*.

It is effective to provide the first cell C1 such that the first cell C1 faces the hole 21*f* at a position of an antinode of a sound pressure of standing waves as reduction target generated in the front cavity 5*f*. It is necessary to appropriately determine at least one of the volume S of the cavity, the depth L of the hole 21*f*, and the area S of the hole 21*f* so that a frequency of standing waves whose antinode of a sound pressure is generated at a position where the first cell C1 faces the hole 21*f* is the Helmholtz resonance frequency fr.

A cavity of the second cell C2 shown in FIG. 4 is communicated with a hole 21*b* provided in the back surface 2*b* of the baffle plate 2. The second cell C2 is used as a portion that suppresses or reduces standing waves generated in the back cavity 5*b*.

It is effective to provide the second cell C2 such that the second cell C2 faces the hole 21*b* at a position of an antinode of a sound pressure of standing waves as reduction target generated in the back cavity 5*b*. It is necessary to appropriately determine at least one of the volume S of the cavity, the depth L of the hole 21*b*, and the area S of the hole 21*b* so that a frequency of standing waves whose antinode of a sound pressure is generated at a position where the second cell C2 faces the hole 21*b* is the Helmholtz resonance frequency fr.

A cavity of the third cell C3 shown in FIG. 5 is communicated with both the hole 21*f* provided in the front surface 2*f* and the hole 21*b* provided in the back surface 2*b* of the baffle plate 2. The third cell C3 connects the front cavity 5*f* and the back cavity 5*b*.

When a cell that connects an air layer of the front surface 2*f* and an air layer of the back surface 2*b* of the baffle plate 2 is provided as the third cell C3, a sound pressure in the back cavity 5*b* having a phase opposite to a phase of a sound pressure in the front cavity 5*f* leaks into the front cavity 5*f*. In particular, such an influence is obvious in a low frequency band having a long wavelength. Therefore, an emitted sound pressure level in a low frequency band can be reduced by increasing the number of the third cells C3.

In order to confirm the effect of the present embodiment, the inventors of the present application prototyped the headphone 100 in which the first cell C1 having a Helmholtz resonance frequency around 4 kHz to 5 kHz is provided in the baffle plate 2, and measured acoustic characteristics of the prototyped headphone 100.

Figure 6:
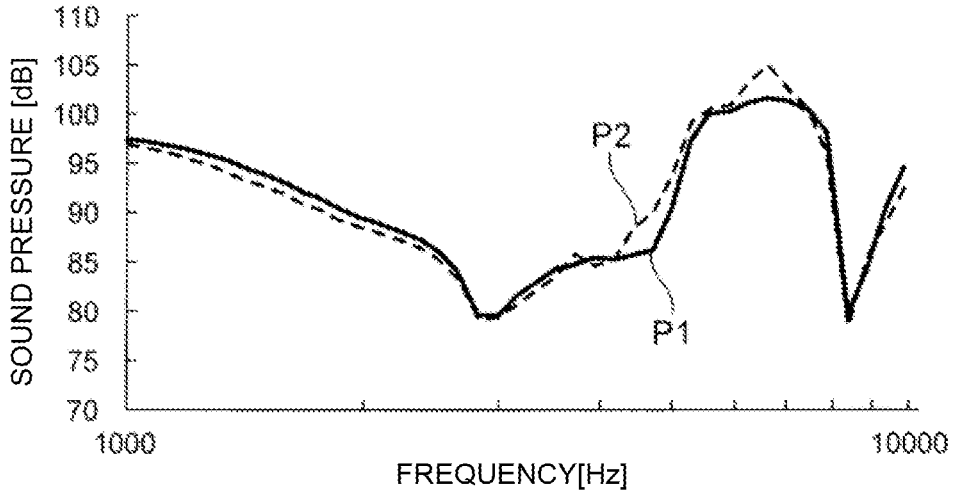
FIG. 6 is a view showing an effect of the first cell.

FIG. 6 is a view showing frequency characteristics of a sound pressure measured at a predetermined position in the front cavity 5*f* when a sound is emitted from the speaker unit 1 of the prototyped headphone 100. A horizontal axis represents a frequency, and a vertical axis represents a sound pressure in FIG. 6. P1 indicates frequency characteristics of a sound pressure in a comparative example in which the first cell C1 is not provided in the baffle plate 2, and P2 indicates frequency characteristics of a sound pressure in the prototyped headphone 100 in which the first cell C1 is provided in the baffle plate 2.

In the comparative example, a dip occurs in the frequency characteristics P1 around 4 kHz to 5 kHz due to an influence of standing waves generated in the front cavity 5*f*. On the other hand, it can be confirmed that the dip disappears since a sound pressure around 4 kHz to 5 kHz is increased by about 3 dB to 4 dB in the frequency characteristics P2 of a sound pressure of the prototyped headphone 100. It is considered that this is because standing waves having a frequency around 4 kHz to 5 kHz are suppressed by the Helmholtz resonance in the first cell C1.

The inventors of the present application prototyped a plurality of types of headphones 100 in which the number of third cells C3 in the baffle plate 2 is different, and measured acoustic characteristics of the prototyped headphones 100. In the prototyped headphones 100, an area of each of two holes provided in the third cell C3 is about 1.57 $mm^2$.

Figure 7:
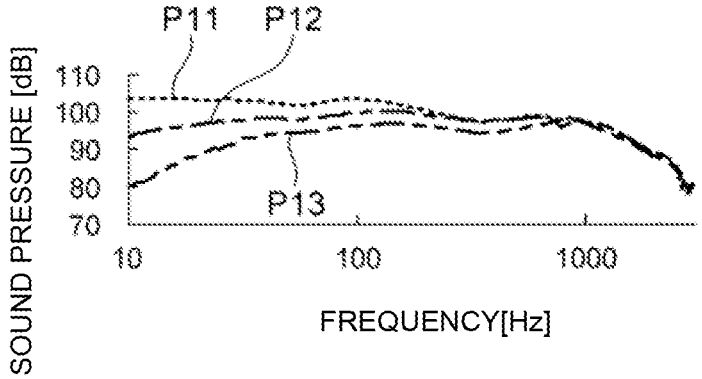
FIG. 7 is a view showing an effect of the third cell.

FIG. 7 is a view showing frequency characteristics of sound pressures obtained by the measurement. In FIG. 7, P11 indicates frequency characteristics of a sound pressure when the number of the third cells C3 provided in the baffle plate 2 is N1, P12 indicates frequency characteristics of a sound pressure when the number of the third cells C3 provided in the baffle plate 2 is N2 (>N1), and P13 indicates frequency characteristics of a sound pressure when the number of the third cells C3 provided in the baffle plate 2 is N3 (>N2).

As shown in FIG. 7, a sound pressure of an emitted sound in a low frequency band can be reduced by changing or increasing the number of the third cells C3. For example, a volume in the low frequency band can be adjusted such that frequency characteristics of a sound pressure are flat as in the frequency characteristics P12 shown in FIG. 7 by adjusting the number of the third cells C3.

Figure 8:
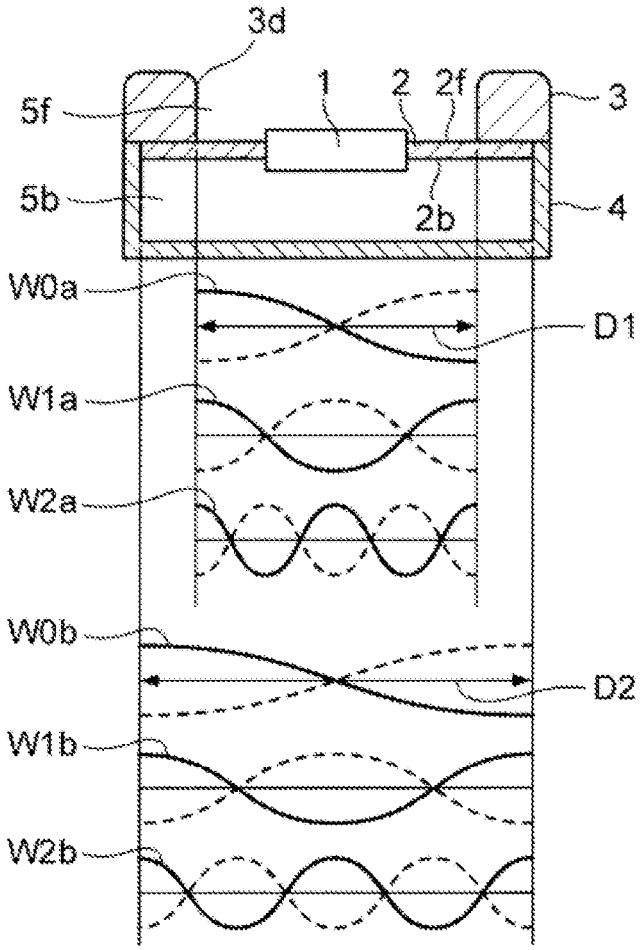
FIG. 8 is a view showing standing waves generated in a front cavity and a back cavity in a design example of the inventive headphone.

Hereinafter, a specific design example of the present embodiment will be described. FIG. 8 is a view showing standing waves generated in the front cavity 5*f* and the back cavity 5*b* in the design example. In FIG. 8, the cylindrical front cavity 5*f* surrounded by the front surface 2*f* of the baffle plate 2, a head (not shown) of a user, and an inner side surface of the ear pad 3 is formed.

The ear pad 3 formed of a material that reflects a sound is used in the design example. Therefore, a sound reflection occurs on the inner wall surface 3*d* of the ear pad 3, and a standing wave W0*a* having a half wavelength equal to a diameter D1 of an inner wall surface of the front cavity 5*f* having a substantially cylindrical shape, a standing wave W1*a* having one wavelength equal to the diameter D1, a standing wave W2*a* having two wavelengths equal to the diameter D1, and a standing wave (not shown) having a higher frequency are generated in the front cavity 5*f*. A frequency f0*a* of the standing wave W0*a* is calculated by the following formula, in which a sound velocity c is 347 m/s and the diameter D1 is 4 cm.

$$f0a = c/\lambda \quad (2)$$
$$= c/(2D1)$$
$$= 4.3 \text{ kHz}$$

As described above, in the first cell C1, when the cross-sectional area S of the hole 21 is 0.79 $mm^2$ (corresponding to an area of a circle having a diameter of 1 mm), the depth L of the hole 21 is 2 mm, and the volume V of the cavity of the cell C communicated with the hole 21 is 65 $mm^3$, the Helmholtz resonance frequency fr of the first cell C1 is 4.2 kHz. Accordingly, the Helmholtz resonance frequency fr can be set to a frequency close to the frequency f0*a* of the standing wave W0*a*.

The housing 4 having the back cavity 5*b* is also formed of a material that reflects a sound in the design example. Therefore, a sound reflection occurs on an inner wall surface of the housing 4, and a standing wave W0*b* having a half wavelength equal to a diameter D2 of the back cavity 5*b* having a substantially cylindrical shape, a standing wave W1*b* having one wavelength equal to the diameter D2, a standing wave W2*b* having two wavelengths equal to the diameter D2, and a standing wave (not shown) having a higher frequency are generated in the back cavity 5*b*.

Figure 9:
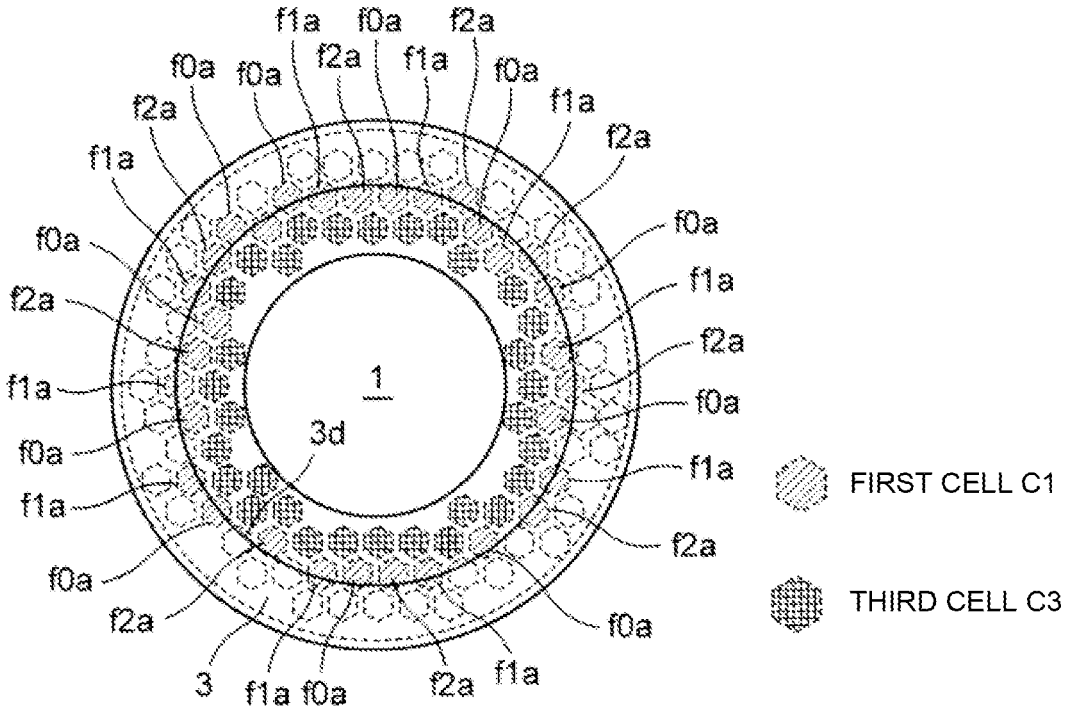
FIG. 9 is a view showing an arrangement of the first cell and the third cell in the design example.

As shown in FIG. 8, antinodes of sound pressures of the standing waves W0*a*, W1*a*, and W2*a* are generated at a position of the inner wall surface 3*d* of the ear pad 3 in the front cavity 5*f* Therefore, as shown in FIG. 9, among all of the cells C in the baffle plate 2, a plurality of cells C that are closest to the inner wall surface 3*d* of the ear pad 3 are set as the first cells C1 in the design example. A plurality of first cells C1 are arranged in a circle in the baffle plate 2. In the design example, a first cell C1 in which a resonance frequency is a frequency f0*a* of the standing wave W0*a*, a first cell C1 in which a resonance frequency is a frequency f1*a* of the standing wave W1*a*, and a first cell C1 in which a resonance frequency is a frequency f2*a* of the standing wave W2*a* are sequentially provided along the circle.

Figure 10:
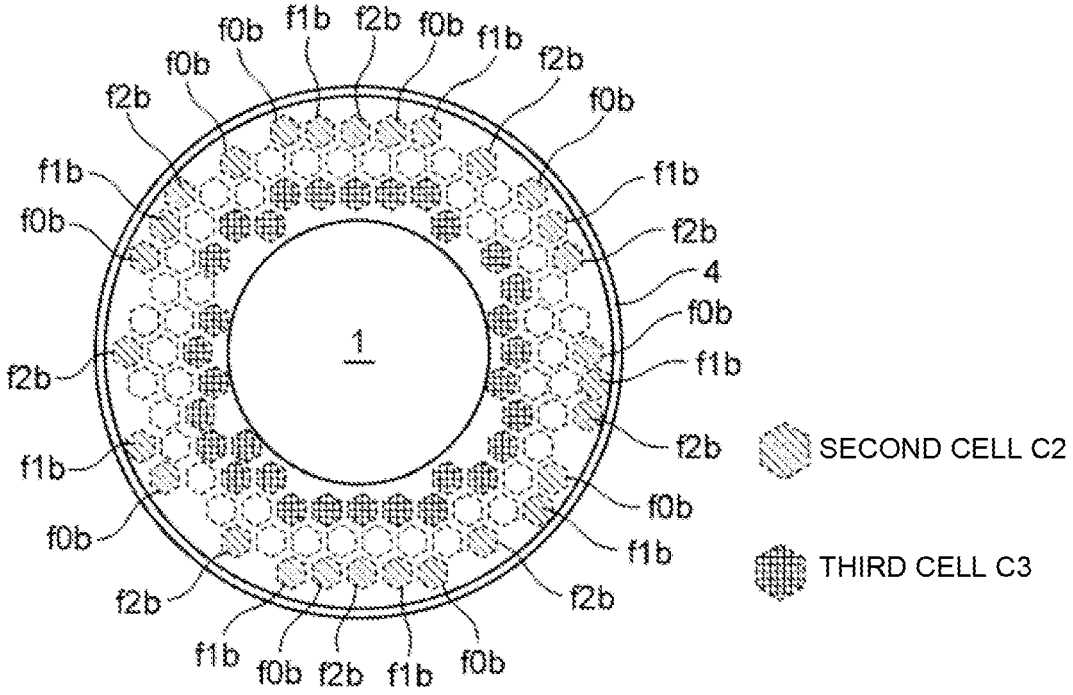
FIG. 10 is a view showing an arrangement of the second cell and the third cell in the design example.

As shown in FIG. 8, antinodes of sound pressures of the standing waves W0*b*, W1*b*, and W2*b* are generated at a position of the inner wall surface of the housing 4 in the back cavity 5*b*. Therefore, as shown in FIG. 10, among all of the cells C in the baffle plate 2, a plurality of cells C that are closest to the inner wall surface of housing 4 are set as the second cells C2 in the design example. A plurality of second cells C2 are arranged in a circle in the baffle plate 2. In the design example, a second cell C2 in which a resonance frequency is a frequency f0*b* of the standing wave W0*b*, a second cell C2 in which a resonance frequency is a frequency f1*b* of the standing wave W1*b*, and a second cell C2 in which a resonance frequency is a frequency f2*b* of the standing wave W2*b* are sequentially provided along the circle.

In the design example, among the cells C in a region interposed between the ear pad 3 and the speaker unit 1 at the front surface 2*f* side of the baffle plate 2, a cell C that is neither the first cell C1 nor the second cell C2 is set as the third cell C3. In the example shown in FIGS. 9 and 10, a cell C in a region inside a region where the first cell C1 is disposed and outside a region where the second cell C2 is disposed is the third cell C3 in the baffle plate 2. Even if there is a cell C that is neither the first cell C1 nor the second cell C2, the cell C may not be the third cell C3 when the cell C is within a region occupied by the ear pad 3. Therefore, there is a cell C that is none of the first cell C1, the second cell C2, and the third cell C3 in the example shown in FIGS. 9 and 10.

The hole 21*f* of the first cell C1 and the hole 21*b* of the second cell C2 may be provided at the center of a bottom surface of each cell. Alternatively, when acoustic characteristics are important, the hole 21*f* and the hole 21*b* may be brought as close as possible to a position of an antinode of a sound pressure of standing waves.

For example, FIG. 9 shows first cells C1 through which a circle defined by the inner wall surface 3*d* of the ear pad 3 crosses, and first cells C1 that are separated from the inner wall surface of the ear pad 3 toward an inner side (the speaker unit 1 side), and the hole 21*f* of each of the first cells C1 is provided at a position that is closest to the inner wall surface of the ear pad 3 in a region forming a bottom surface of the first cell C1 in the baffle plate 2.

FIG. 8 shows the second cells C2 that are separated from the inner wall surface of the housing 4 toward an inner side (the speaker unit 1 side), and the hole 21*b* of each of the second cells C2 is provided at a position that is closest to the inner wall surface of the housing 4 in a region forming a bottom surface of the second cell C2 in the baffle plate 2.

As described above, the first cell C1 provided with a hole at a position of an antinode of a sound pressure of standing waves generated in the front cavity 5*f* and the second cell C2 provided with a hole at a position of an antinode of a sound pressure of standing waves generated in the back cavity 5*b* are provided in the baffle plate 2, and the third cell C3 is provided in a region of the baffle plate 2 where the first cell C1 and the second cell C2 are not provided in the design example. According to the design example, the standing waves generated in the front cavity 5*f* and the standing waves generated in the back cavity 5*b* can be sufficiently suppressed, and a sound in a low frequency band among sounds emitted from the speaker unit 1 can be suppressed.

Next, effects of the present embodiment will be described. A headphone in the related art has a problem that standing waves (acoustic mode) of a sound are generated in a front cavity formed by an ear pad and a head of a user, a peak dip occurs in frequency characteristics of an emitted sound, and sound quality deteriorates.

In this case, the acoustic mode is handled in most cases by providing a sound absorbing material or the like in the front cavity. However, when a sound absorbing material or the like is provided, costs are increased. In addition, when the sound absorbing material is provided in the front cavity, another problem such as unnecessarily absorbing an emitted sound occurs since the sound absorbing material affects the entire frequency band including a high frequency band.

According to the present embodiment, since the first cell C1 provided in the baffle plate 2 functions as a Helmholtz resonator and suppresses standing waves generated in the front cavity 5*f*, deterioration of sound quality can be prevented. In this case, since no sound absorbing material or the like is used, costs are not increased, and the problem such as unnecessarily absorbing an emitted sound does not occur in the present embodiment.

Among various types of headphones, there is a sealed headphone in which a back surface of a baffle plate is covered with a housing. This type of sealed headphone has a problem that standing waves (acoustic mode) of a sound is generated in a back cavity surrounded by the back surface of the baffle plate and the housing, a peak dip occurs in frequency characteristics of an emitted sound, and sound quality deteriorates.

According to the present embodiment, since the second cell C2 provided in the baffle plate 2 functions as a Helmholtz resonator and suppresses standing waves generated in the back cavity 5*b*, deterioration of sound quality can be prevented. In this case, since no sound absorbing material or the like is used, costs are not increased, and the problem such as unnecessarily absorbing an emitted sound does not occur in the present embodiment.

In general, a headphone requires a structure for adjusting a volume in a low frequency band. A headphone in the related art is provided with, for example, a case (inner case) in which a hole is provided in a back surface of a baffle plate, and the volume in a low frequency band emitted from a speaker unit is adjusted by adjusting an air spring on the back surface. Although the volume in the low frequency band can be adjusted with such a structure, costs are increased since a component is added.

According to the present embodiment, since the third cell C3 provided in the baffle plate 2 connects the air layer in the front cavity 5*f* and the air layer in the back cavity 5*b*, a sound pressure in the back cavity 5*b* having a phase opposite to a phase of a sound pressure in the front cavity 5*f* leaks into the front cavity 5*f* side. Therefore, since the third cell C3 is provided, the volume in a low frequency band can be adjusted without adding a new component.

Since a headphone is worn on a head, it is desirable to reduce the weight of the headphone while maintaining necessary and sufficient rigidity. According to the present embodiment, since a plurality of cells C having cavities are provided at different positions in the baffle plate 2, it is possible to reduce the weight of the headphone 100 while maintaining necessary and sufficient rigidity.

(1) In the embodiment described above, the first cell C1, the second cell C2, and the third cell C3 are provided in the baffle plate 2. Alternatively, the third cell C3 may not be provided, and only the first cell C1 and the second cell C2 may be provided in the baffle plate.

(2) In the embodiment described above, the first cell C1, the second cell C2, and the third cell C3 are provided in the baffle plate 2. Alternatively, for example, when it is important to suppress standing waves in the front cavity 5*f*, all cells C in the baffle plate 2 in a region (region between the inner wall surface of the ear pad 3 and the speaker unit 1) where the first cells C1 can be provided may be set to the first cells C1 each having the hole 21*f* in the front surface 2*f* of the baffle plate 2.

(3) In the embodiment described above, the first cell C1, the second cell C2, and the third cell C3 are provided in the baffle plate 2. Alternatively, for example, when it is important to suppress standing waves in the back cavity 5*b*, all cells C in the baffle plate 2 in a region (region within the inner wall surface of the housing 4) where the second cells C2 can be provided may be set to the second cells C2 each having the hole 21*b* in the back surface 2*b* of the baffle plate 2.

(4) In the embodiment described above, all cells C provided in the baffle plate 2 have the same size. Alternatively, a plurality of cells C of different sizes may be provided in the baffle plate 2. According to this embodiment, the first cell C1 or the second cell C2 having a desired Helmholtz resonance frequency can be formed by forming the hole 21*f* or 21*b* in a cell C having a desired size.

(5) In the embodiment described above, a plurality of types of holes 21*f* or 21*b* having different lengths L or areas S may be provided in the plurality of cells C to form a plurality of types of first cells C1 or second cells 2 having a desired Helmholtz resonance frequency.

(6) In the embodiment described above, although the cell C having a cavity and a regular hexagonal prism shape is provided in the baffle plate 2, a shape of the cell C is not limited to the regular hexagonal prism. The cell C having any shape such as a polygonal prism shape and a cylindrical shape can be provided in the baffle plate 2.

What is claimed is:

1. A headphone comprising:

a speaker unit;

a baffle plate that supports the speaker unit;

an ear pad attached to a front surface of the baffle plate; and a housing that covers a back surface of the baffle plate opposite to the front surface and surrounds a space together with the back surface of the baffle plate, wherein the baffle plate has at least one cell having a cavity;

a part of the at least one cell has a hole communicated with the cavity, and the hole is provided in the back surface of the baffle plate; and the cavity and the hole are communicated with each other through the hole provided in the back surface of the baffle plate.

2. The headphone according to claim 1, wherein the baffle plate has a plurality of cells at different positions from each other.

3. The headphone according to claim 2, wherein the plurality of cells include a first cell having a hole in the front surface of the baffle plate and a second cell having the hole in the back surface of the baffle plate.

4. The headphone according to claim 3, wherein the plurality of cells include a third cell having the holes in both the front surface and the back surface of the baffle plate.

5. The headphone according to claim 2, wherein in the baffle plate, the hole is provided in the cell located at a position of an antinode of standing waves generated in a space facing the baffle plate.

6. The headphone according to claim 2, wherein all of the plurality of cells that each have a hole communicated with the cavity are first cells each having the hole in the front surface of the baffle plate.

7. The headphone according to claim 2, wherein all of the plurality of cells that each have a hole communicated with the cavity are second cells each having the hole in the back surface of the baffle plate.

8. The headphone according to claim 2, wherein the plurality of cells have a same size.

9. The headphone according to claim 2, wherein the plurality of cells have different sizes.

* * * * *